United States Patent [19]

Ngan

[11] Patent Number: 4,804,457

[45] Date of Patent: Feb. 14, 1989

[54] PROCESS FOR REMOVAL OF POLYNUCLEAR AROMATICS FROM A HYDROCARBON IN AN ENDOTHERMIC REFORMER REACTION SYSTEM

[75] Inventor: Danny Y. Ngan, Houston, Tex.

[73] Assignee: Shell Oil Company, Houston, Tex.

[21] Appl. No.: 76,507

[22] Filed: Jul. 22, 1987

[51] Int. Cl.[4] ..... C10G 35/04; C10G 35/06

[52] U.S. Cl. ..... 208/64; 208/65

[58] Field of Search ..... 208/64, 65

[56] References Cited

U.S. PATENT DOCUMENTS

| | | | |
|---|---|---|---|
| 2,632,727 | 8/1950 | Lanneau et al. | 196/52 |
| 2,819,326 | 1/1958 | Mills | 260/674 |
| 2,867,582 | 1/1959 | Shuman et al. | 208/310 |
| 2,940,926 | 6/1960 | Henke et al. | 208/310 |
| 3,340,316 | 9/1967 | Wacker et al. | 260/674 |
| 3,513,089 | 5/1970 | Geach et al. | 208/310 |
| 3,689,404 | 9/1972 | Hofer et al. | 208/310 |
| 3,767,563 | 10/1973 | Woodle | 208/85 |
| 3,981,792 | 9/1976 | Scott | 208/49 |
| 4,032,431 | 6/1977 | Weisz | 208/62 |
| 4,048,058 | 9/1977 | Petersen et al. | 208/138 |
| 4,125,454 | 11/1978 | Clem et al. | 208/65 |
| 4,292,167 | 9/1981 | Bonacci et al. | 208/66 |
| 4,411,768 | 10/1988 | Unger et al. | 208/59 |
| 4,447,315 | 5/1984 | Lamb et al. | 208/99 |
| 4,592,829 | 6/1986 | Eberly | 208/135 |
| 4,608,153 | 8/1986 | Hudson et al. | 208/112 |
| 4,664,777 | 5/1987 | Hudson et al. | 208/112 |

*Primary Examiner*—Curtis R. Davis

*Attorney, Agent, or Firm*—Kimbley L. Muller

[57] ABSTRACT

A process is disclosed for reforming a hydrocarbon in a multi-stage endothermic reforming series of reforming reactors where the hydrocarbon is passed through a series of reforming reactors to form a reformate with substantial reduction in polynuclear aromatic compounds. An adsorption zone comprising an adsorbent selective for adsorption of polynuclear aromatics is situated intermediate the series of reactors. The adsorbent is followed by an intermediate heating means to insure that the temperature of the hydrocarbon product entering the next reforming stage is at a temperature sufficient that the hydrocarbon product will have a temperature of at least 750° F. when egressing from the next respective reforming zone. The contemplated reforming feeds are $C_6$ to $C_{10}$ naphthas having a boiling point of 100° F. to 400° F. while the ultimate reformate is used as a blending agent for gasolines to increase the octane value of the respective gasoline.

20 Claims, 1 Drawing Sheet

PROCESS FOR REMOVAL OF POLYNUCLEAR AROMATICS FROM A HYDROCARBON IN AN ENDOTHERMIC REFORMER REACTION SYSTEM

FIELD OF THE INVENTION

The field of this invention relates to upgrading of a hydrocarbon material to a hydrocarbon material of higher octane. This process is commonly referred to as reforming, usually performed in the presence of hydrogen. The modification of the hydrocarbon material is accomplished by dehydrogenation, dehydroisomerization, dehydrocyclization and isomerization to produce an aromatic material from an aliphatic material.

Reforming is basically an endothermic process and consequently most refiners have situated a plurality of adiabatic fixed-bed reactors in series with heat means inter-staging the adiabatic reactors in order to maintain proper heat balance. The reformate produced in these adiabatic reactors is desirably substantially free of polynuclear aromatic compounds. The field of this invention relates to a process flow scheme to achieve that result.

BACKGROUND OF THE INVENTION

With the exception of crude distillation, reforming is probably practiced more widely throughout the world than any other hydrocarbon processing reaction. In reforming, naphthene rings derived from paraffins are dehydrogenated into aromatic rings in the presence of a catalyst. The reformate will usually contain from 35 to 60 percent by weight of benzene, toluene and xylenes. Reforming catalysts are usually noble metals, such as platinum, or mixtures of platinum metals such as platinum and rhenium, on acidic supports such as alumina. Potential problems indigenous to reforming include polynuclear aromatic content in the reformate and heat balance in the overall endothermic catalytic process.

A process for the suppression of catalyst deactivation and for maintaining proper heat balance was disclosed in Clem et al, U.S. Pat. No. 4,125,454, where a series of reactors for reforming is positioned where the reactor next scheduled to have its catalyst-regenerated is located immediately downstream of a reactor which contains freshly regenerated catalyst. In this manner, any sulfur expelled during reforming in the presence of newly regenerated catalyst is adsorbed on the coke of the catalyst which is in a near spent state. In Bonacci et al, U.S. Pat. No. 4,292,167, a process is disclosed for a multi-stage reforming reactor where the first reforming stage effluent is cooled and contacted with a ZSM-5 type zeolite prior to intermediate heating between the reformer zones. It is recognized that as naphtha passes through each reforming stage, the endothermic reactions which take place result in a lowering of the temperature. This requires intermediate heating between the reformer stages. It is recognized that reforming catalyst is not particularly active at temperatures below 800° F. and therefore each reactor should be designed to operate at exit temperatures above this particular level. Many sophisticated systems have been developed to heat balance multi-stage reforming reactions. One such sophisticated heat exchange method is disclosed in Scott, U.S. Pat. No. 3,981,792.

In Hofer et al, U.S. Pat. No. 3,689,404, an adsorption process is described using activated carbon to remove naphthalenes and alkyl substituted naphthalenes from refined petroleum fractions including catalytic reformate. In this manner dicyclic hydrocarbons are separated from a mixture of dicyclic, monocyclic and paraffinic hydrocarbons utilizing an activated carbon adsorbent. In Wackher et al, U.S. Pat. No. 3,340,316, a process is described for the separation of aromatics by means of activated carbon containing a polar fluoride molecule and having as a cation ammonia or an element from Groups I, II and III of the Periodic Table. This separation may be performed on charge stocks such as those derived from thermal or catalytically cracked materials, catalytically dehydrogenated petroleum fractions and straight run distillate fractions. It is recognized that processes for the separation of aromatic hydrocarbons using selective sorbents are well known in the art and that U.S. Pat. No. 2,819,326, Mills, is disclosive of a process for the separation of polynuclear aromatics from mononuclear aromatics employing silica gel as the selective sorbent. Certain coke precursors to thermal or catalytic cracking reactors are removed from motor fuel range hydrocarbons by means of silica gel or alumina (U.S. Pat. No. 2,632,727, Lanneau et al). By this method all potential coking poisons are removed from the feedstock by adsorption on silica gel prior to cracking.

Separation of aromatics from gasoline reformates, especially catalytic reformates with an adsorbent such as activated charcoal or activated alumina, is disclosed in Shuman, U.S Pat. No. 2,867,582. Recognition of the problems of polynuclear aromatics in motor fuel reformates was disclosed in Hudson et al, U.S. Pat. No. 4,608,153. However, in deference to removing these polynuclear aromatics by means of adsorption, a catalytic system was devised containing elemental iron, one or more alkali metal or alkaline earth metals of the Periodic Table and a Group III-A compound such as alumina. Certain crystalline dehydrated zeolites have been shown as molecular sieves for an adsorption process to separate paraffins from aromatic materials. See Henke et al, U.S. Pat. No. 2,940,926. The subject of such separation is taught as a catalytic reforming product to enable recycle of the saturated fraction to catalytic reforming while recovering high octane aromatic hydrocarbons. Graphite has also been shown as a material for hydrocarbon separation as taught in Geach et al, U.S. Pat. No. 3,531,089. Finally, a multi-stage adsorption separation technique for hydrocarbons is disclosed in Woodle, U.S. Pat. No. 3,767,563. Other separatory processes include U.S. Pat. Nos. 4,032,431; Weisz, 4,447,315; Lamb, and 4,411,768 Unger.

These disclosures have failed to recognize the harmful cumulative effect of the polynuclear aromatics as the reforming hydrocarbons pass through the adiabatic reforming stages. There is no recognition in this art of the tremendous reduction achieved in the reformate polynuclear aromatic content by intermittently eliminating the polynuclear aromatics from the beginning of each reforming bed. There is also a failure to recognize that as a hydrocarbon is passed through each respective reforming bed that polynuclear aromatic content accumulates exponentially during endothermic reforming.

OBJECTS AND EMBODIMENTS

An object of this invention is to provide an endothermic reforming process whereby the reformate acquired from reforming has a lower polynuclear aromatic content. Adaptation of this process will substantially reduce the necessity to contact the reformate with an adsorbent to eliminate the polynuclear aromatic materials from the reformate. Reduction in polyaromatics content will reduce the gumming tendency of the gasoline.

Another object of this invention is to provide an endothermic catalytic reforming reaction process sequence with increased catalyst life and increased run time in between catalyst regeneration, i.e. increased capacity & reduced regeneration cost, as a result of a reduction in coking caused by the presence of polynuclear aromatic materials which are excised from each particular reforming stage of the process.

A further object of this invention is to provide an adiabatic series of reforming reactors having in their bottommost portion a polynuclear aromatic adsorption zone to intermittently remove relatively small quantities of polynuclear aromatics and thereby prevent their accumulation during reforming.

Another object of this invention is to provide a process which may be applied to retrofit existing reforming units and thereby eliminate polynuclear aromatics from the reformate.

One embodiment of this invention resides in a process for reforming a hydrocarbon in a multi-stage endothermic reforming series of reactors where said hydrocarbon is passed through said series of reactors to form a reformate and where said hydrocarbon is heated prior to entry to the next reactor in said series which process comprises contact of said hydrocarbon intermediate from said series of catalytic reforming reactors containing reforming catalyst with a polynuclear aromatic adsorbent to adsorb at least a portion of said polynuclear content of said hydrocarbon prior to entry to the next reactor in said series and recovering a reformate from the last reactor in said series having a reduced content of polynuclear aromatics.

Another embodiment of this invention resides in a process to prepare a hydrocarbon reformate with a reduced amount of polynuclear aromatic compounds which comprises: heating a feed stream containing polynuclear aromatic compounds to a temperature of from about 800° F. to about 1000° F. prior to entry to a hereinafter defined series of endothermic reforming reactors to provide a heated feed stream containing polynuclear aromatic compounds; passing said heated feed stream to a first of a series of endothermic catalytic reforming reactors operated at a temperature of from about 800° F. to about 1000° F. to reform said feed stream to a hydrocarbon of higher octane value and to provide for a first reforming reactor effluent containing polynuclear aromatic compounds; contacting said first reforming reactor effluent with a first adsorbent effective to selectively adsorb said polynuclear aromatic compounds and to permit nonpolynuclear aromatic hydrocarbons to pass over said first adsorbent without being adsorbed and to form a first adsorbent bed effluent stream having a reduced amount of polynuclear aromatic compounds; heating said first adsorbent bed effluent stream to a temperature of from about 800° F. to about 1000° F. to form a second reforming reactor feed stream; passing said heated adsorbent bed feed stream to a second of a series of endothermic catalytic reforming reactors operated at a temperature of from about 800° F. to about 1000° F. to reform said feed stream to a hydrocarbon of higher octane value and to provide for a second reforming reactor effluent containing polynuclear aromatic compounds; contacting said second reforming reactor effluent with a second adsorbent effective to selectively adsorb said polynuclear aromatic compounds and to permit non-polynuclear aromatic hydrocarbons to pass over said adsorbent without being adsorbed and to form a second adsorbent bed effluent stream having a reduced amount of polynuclear aromatic compounds; heating said second adsorbent bed effluent stream to a temperature of from about 800° F. to about 1000° F. to form a feed stream for the next consecutive reforming reactor; continuing said reforming reactors in a series of subsequent catalytic reforming reactors with said intermediate polynuclear aromatic compound adsorption; and recovering a hydrocarbon reformate from the last of said series of reforming reactors having a reduced content of polynuclear aromatic compounds.

BRIEF DESCRIPTION OF THE INVENTION

Inter-reactor polynuclear aromatic adsorption traps are situated in this process intermediate endothermic reforming reactors to remove any polynuclear aromatic compounds formed in the former reforming processing. The adsorption zone preferably comprises a refractory inorganic oxide selective for the separation of polynuclear aromatics vis-a-vis mononuclear aromatics (benzene, toluene, xylene, etc.) and normal paraffinic saturated hydrocarbons.

DETAILED DESCRIPTION OF INVENTION

Figure 1:
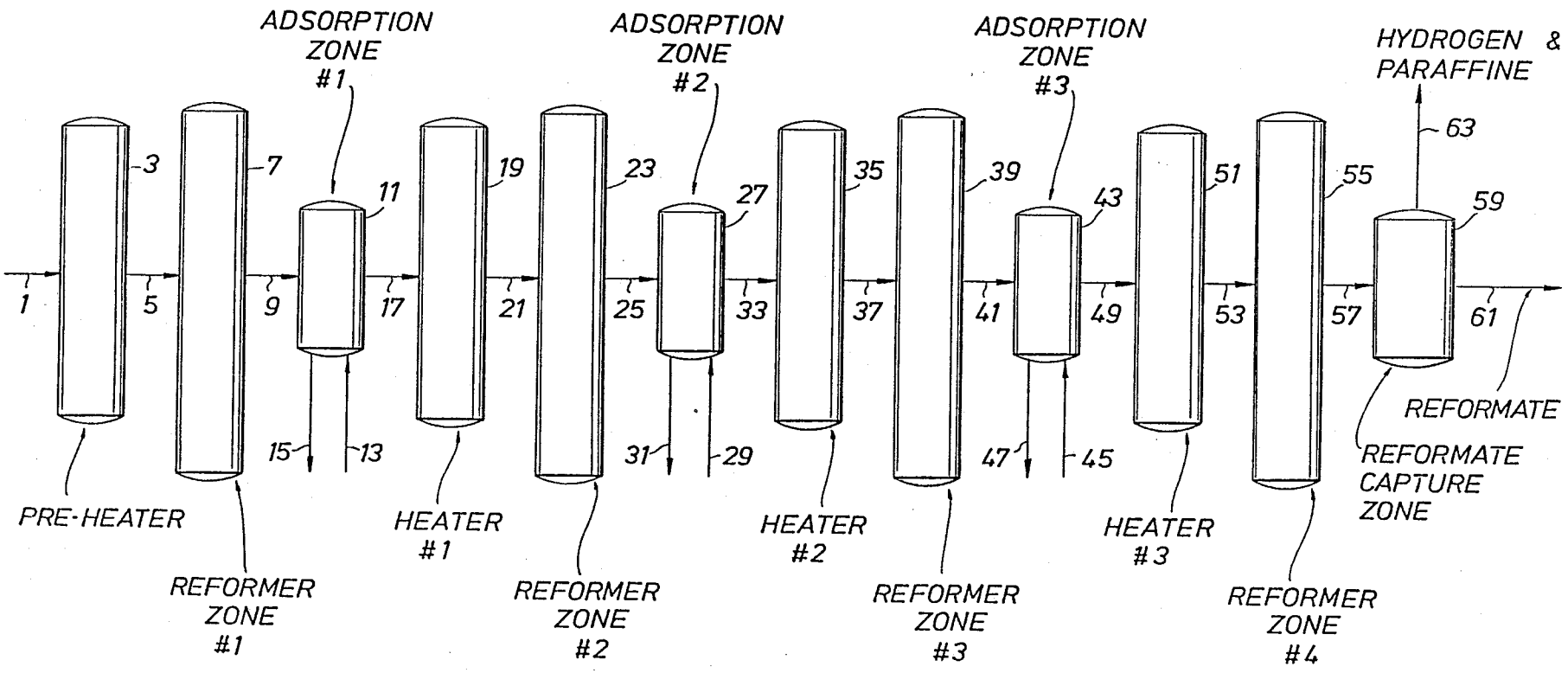

This invention is concerned with a process for the reformation of paraffins, particularly aliphatic paraffins containing six or more carbon atoms, into aromatic material. Some olefins may be present in the feedstock. A preferred feedstock of this invention comprises $C_6$ to $C_{10}$ naphthas having a boiling point of from about 100° F. to about 400° F. Mixtures of paraffins and naphthas may also be utilized as feedstock where the mixture has a boiling range of from 100° F. to 400° F. This invention relates to the dehydrocyclization of hydrocarbons in addition to formation of cyclic hydrocarbons from aliphatic hydrocarbons.

In such reformation processes most of the reactions which are undertaken are endothermic in nature although the very last step in the dehydrocyclization process may be considered to be exothermic. In view of this type of process, a plurality of adiabatic fixed-bed reactors is present in series with provision for interstage heating of the feed to each of the several reactors. The additional heat may comprise indirect heat exchange or the direct passage of steam or another heat sink to elevate the temperature of the hydrocarbon. Most reforming operations are performed in the presence of hydrogen which acts as a diluent for the reformation of the hydrocarbons.

Catalytic materials utilized in the reforming reaction are conventional dehydrocyclization reforming catalysts exemplified by noble metals deposited on an inorganic oxide support. Specific examples of these noble metals will be selected from cobalt, nickel, copper, iron, ruthenium, rhodium, palladium, osmium, iridium, and platinum. The process conditions undertaken during reforming generally are temperatures of from about 750° F. to 1250° F. and preferably between 900° F. and 1150° F. The pressure existing during the reforming reaction should be generally in the range of 60 to 120 psig. The hydrocarbon feed rate for a reforming process is expressed in weight hourly space velocity (WHSB) in the range of from about 0.5 to 2.0. Hydrogen is present during reforming in surplusage quantities derivative of the reforming reaction. When steam is used as a reforming diluent, the molar ratio of steam to fresh feed initially is in the range of 5:1 to 25:1 as the reaction progresses.

It is preferred that the temperature in the lowermost portion of each adiabatic reforming bed be not less than 750° F. to insure proper catalytic reforming of the hydrocarbons. For this reason, a heat means is placed intermediate each particular adiabatic reforming bed to raise the temperature of the reforming hydrocarbon in that bed to a level of approximately 1000° F. This insures that the temperature in the bottommost portion of the adiabatic reforming bed is maintained at a level of at least 750° F. The heat means intermediate the reforming reactors can be an indirect heat exchange means as derived from other refinery process flow streams having temperatures greater than 1000° F. or it can be by means of direct heat added at that point in the process. It is preferred that the polynuclear aromatic adsorption take place prior to intermediate heating as it has been discovered that the lower the temperature during adsorption, the greater the amount of polynuclear aromatics that will be adsorbed by the selective adsorbent.

The polynuclear aromatics which are removed by this process preferably have three, four, five or even a higher number of aromatic rings. While it is contemplated that naphthalenes may also be removed, it is not absolutely critical that they be excised in order to have a reformate of extremely high octane quality. The reformate produced by this process should be between 40 and 60 percent aromatic with any paraffins comprising the majority of the other components. This intermediate system of polynuclear aromatic adsorption drastically reduces the polynuclear aromatic content of the reformate. If necessary, the paraffinic materials can be separated from the reformate and recycled to the reforming stages for development into high octane aromatic materials.

The instantinvention proposes that the polynuclear aromatics be removed from the feed prior to contact with the first adiabatic reforming reactor. Intermediate the reforming reactor beds a trap of an adsorbent selective for the adsorption of polynuclear aromatics is situated. The adsorption sieves which are selective for the polynuclear aromatic hydrocarbons, comprise a molecular sieve, silica gel, silica, alumina, activated alumina, activated carbon, silica-alumina and various clays. It is not necessary that the sieve be comprised of a specific material as long as it is a selective sieve for the adsorption of the polynuclear aromatics from the paraffins and reformate. It is also contemplated that this adsorption zone be situated in the bottom portion of each individual reforming reactor to adsorb the polynuclear aromatics being generated in that reactor or being added by a recycle stream to the reactor. Since the adsorption of the polynuclear aromatics is better at lower temperatures, it is preferred that the intermediate adsorption be done immediately after the hydrocarbon leaves the reforming catalyst bed but previous to intermediate heat of the feed material to the next adiabatic reforming bed. In the embodiment where the adsorption bed is placed in the bottom portion of the reforming reactor, the same will be regenerated coextensive with the catalyst regeneration in the reforming bed.

One advantage of this invention is that the removal of the polynuclear aromatics will reduce the coking rate on the catalyst in the reactors, and thereby the frequency of reactor regeneration. The reduced polynuclear aromatics in the reformate will also provide a high octane material which does not need to be treated in order to be used as a blending component for gasolines.

The high amount of polynuclear aromatics in the feed may be treated with an adsorbent bed before contact with the first reactor. This is preferred but not required. The higher the amount of polynuclear nuclear aromatics in the feed material, the higher the amount of polynuclear aromatics formed in the respective product streams of each intermediate reforming reactor. The rate of polynuclear aromatic formation is therefore strongly dependent on the concentration of the polynuclear aromatics entering the reforming reactor. The reduction in the concentration of the polynuclear aromatics in the feed to each reactor substantially reduces the quantity of polynuclear aromatics generated during the reforming steps. This will result in a smaller total polynuclear aromatic concentration in the ultimate reformate.

The separation conditions to remove the polynuclear aromatics from other hydrocarbons by adsorption is performed at as low a temperature as viable and includes contacting conditions including a temperature from about 50° F. to 600° F., a liquid hourly space velocity of from 0.1 to about 500 and a pressure from about 10 psig to about 600 psig. It is preferred that this contacting step be performed at a temperature which will consume as little energy as possible in regard to the reheat of the hydrocarbon via the intermediate heat means.

This invention will be further described in accordance with the instant drawing as follows.

BRIEF DESCRIPTION OF THIS INVENTION

FIG. 1 is a view of the flow scheme of this invention with repeating reforming reactors, adsorption zones, and heat means, which should not be limited by the particular number of units shown.

DETAILED DESCRIPTION OF DRAWING

FIG. 1 demonstrates a serial flow through a multiple stage of adiabatic reactors in which reforming of a feed material occurs to arrive at a reformate. A feed material comprising $C_6$ to $C_{10}$ naphthas having a boiling point of 100° F. to 400° F. is passed through conduit 1 to preheat zone 3 wherein the feed is heated by either an indirect method or by direct flame in requisite burners. The feed leaving preheat zone 3 in conduit 5 has a temperature of about 800° F. to about 1000° F. It is optional within the scope of this invention to place an adsorption zone upstream of first reformer 7 to excise any polynuclear aromatic components present in the feed stream. Any recycle of paraffins and hydrogen passed to any of the reformer zones can be treated in a like manner with an adsorbent bed (not shown) to eliminate polynuclear aromatics in the recycle stream. Assuming there is not a necessity to remove polynuclear aromatics from conduit 5, the heated feed material is passed to first reformer zone 7, containing a standard reforming catalyst, such a platinum-rhenium catalyst dispersed on an alumina support.

The reformation of the hydrocarbon begins in reforming zone 7 to change paraffins and naphthas to aromatic hydrocarbons, i.e., benzene, toluene, xylene. Because of the basic endothermic reaction in the reformer, the temperature in the reformer effluent 9 is substantially lower than the temperture of feed stream 5. In this regard, it is desired to regulate the temperature of the feed in conduit 5 to a degree such that the temperature in conduit 9 leaving the reformer is greater than 700° F. The first adsorption zone is comprised of an adsorbent which is selective for adsorption of polynuclear aromatic compounds to the exclusion of the reformate and unconverted hydrocarbons passed to adsorption zone 11 through conduit 9. Conduits 13 and 15 are provided as a means to regenerate or desorb in adsorption zone 11. A substantially polynuclear aromatic-free reformate and feed material in conduit 17 is withdrawn from adsorption zone 11 and passed to the first intermediate heat means 19, wherein this stream is again heated to a temperature sufficient to provide reforming of the stream in the second reformer reactor. Heat means may be either indirect or direct heat, as dictated by refinery energy demands.

The reformate is withdrawn from heat means 19 in conduit 21 at a temperature of about 1000° F. and passed to the second reformer reactor. This zone contains a similar reforming catalyst to the first reformer reactor zone 7, preferably a platinum-rhenium catalyst dispersed on alumina. Additional reformate, comprising mononuclear aromatics, is formed in reformer reactor 23 and passed, at a lower temperature than the feed stream 21, in conduit 25 to the second adsorption zone 27 containing an adsorbent similar to the adsorbent of adsorption zone 11. This second adsorption zone is likewise designed with conduits 29 and 31 as a means for desorption of the polynuclear aromatic materials or renovation of the adsorbent. After removal of the reformate and feed material from adsorbent bed 27 through conduit 33, the polynuclear aromatic-free reformate is passed to a second intermittent heating unit 35 which raises the temperature of stream 33 to approximately 1000° F. for passage to third reformer reactor 39 by means of conduit 37. The third reformer zone possesses a catalyst very similar to reformer zone 7 and 23 for the continued reformation of the hydrocarbon material. Again, because of the endothermic reaction which occurs in reformer zone 39, the hydrocarbonaceous material in conduit 41 is of considerably lower temperature than the hydrocarbon material of conduit 37. However, this is desired for the particular adsorption in the third adsorption zone 43 to remove the polynuclear aromatic materials 1s maximized at the lower temperature. Conduits 45 and 47 are provided as desorption means of the polynuclear aromatic materials and requisite regeneration means of the adsorbent sieve. It is not necessary, but preferred, that the adsorbent in adsorption zone 43 is the same as the adsorbent in adsorption zones 27 and 11. This sequence of reformation, polynuclear aromatic adsorption and intermediate heating can be continued throughout any number of multiple series of reaction, adsorption and heating zones as desired by the refiner. Polynuclear aromatic-free material is removed from adsorption zone 43 and conduit 49 and heated in intermediate heat means 51 to a temperature of about 1000° F. in stream 53. Continuous reforming can be accomplished in reforming reactor zone 55, shown as the fourth reformer reactor. After termination of these multiple sequential process steps of reforming, adsorption and heating, a high octane reformate stream is formed in conduit 57, which is passed to reformate capture zone 59 for suitable fractionation or distillation of the reformate into a predominantly aromatic stream 61 and a hydrogen and paraffin recycle stream 63, which may in part or in whole be returned to reformer zone 55, 39, 23, or 7.

The above FIG. 1 is shown as a basic flow process scheme of this process and is not to be construed as a limitation thereon.

What is claimed is:

1. A process for reforming a hydrocarbon in a multistage endothermic reforming series of catalytic reforming reactors where said hydrocarbon is passed through said series of catalytic reforming reactors to form a reformate and where said hydrocarbon is heated prior to entry to the next catalytic reforming reactor in said series, which process comprises contact of said hydrocarbon intermediate from said series of catalytic reforming reactors containing reforming catalyst with a polynuclear aromatic adsorbent to adsorb at least a portion of said polynuclear aromatic content from said hydrocarbon prior to entry to each of the next catalytic reforming reactor in said series and recovering a reformate from the last catalytic reforming reactor in said series, said recovered reformate having a reduced content of polynuclear aromatics.

2. The process of claim 1 wherein said hydrocarbon is a naphtha boiling hydrocarbon and said reformate is a hydrocarbon of higher octane value than possessed by said naphtha boiling hydrocarbon.

3. The process of claim 1 wherein said endothermic series of reforming reactors comprises at least three reactors having intermediate heating means to heat the respective reformer effluent from the last reforming reactor to provide that the temperature within said reforming reactors is above about 750° F.

4. The process of claim 3 wherein said heating means comprises indirect heat exchange means or direct heat means.

5. The process of claim 4 wherein said indirect heat exchange means comprises contact with a heat exchanger having a fluid therein of a temperature sufficient to provide that said heat-exchanged hydrocarbon is at a temperature of at least 1000° F.

6. The process of claim 1 wherein said polynuclear adsorbent is selected from the group consisting of molecular sieves, silica, alumina, activated carbon, silica-alumina and clays.

7. The process of claim 1 wherein said contact of said hydrocarbon intermediate said reforming reactor is performed at contacting conditions including an adsorption temperature of from 50° F. to 600° F., a liquid hourly space velocity of from 0.1 to about 500 and a pressure of from 10 psig to 600 psig.

8. The process of claim 1 wherein said polynuclear aromatics are comprised of three or more aromatic rings.

9. The process of claim 1 wherein said reforming catalyst is a crystalline zeolite having a Group VIII metal deposited thereon.

10. The process of claim 1 wherein said recovered reformate is a blending agent for gasoline to increase relative octane number of said gasoline.

11. The process of claim 7 wherein said adsorption temperature is maintained as low as possible to maximize polynuclear aromatic adsorption.

12. The process of claim 1 wherein said adsorption of said polynuclear aromatics are adsorbed in an adsorption zone maintained in a lower portion of said catalytic reforming reactor.

13. A process to prepare a hydrocarbon reformate with a reduced amount of polynuclear aromatic compounds which comprises:

(a) heating a hydrocarbon feed stream containing polynuclear aromatic compounds to a temperature of from about 800° F. to about 1000° F. prior to entry to a hereinafter defined series of endothermic reforming reactors to provide a heated hydrocarbon feed stream containing polynuclear aromatic compounds;

(b) passing said heated hydrocarbon feed stream to a first of a series of endothermic catalytic reforming reactors operated at a temperature of from about 800° F. to about 1000° F. to reform said feed stream in the presence of a reforming catalyst to a hydrocarbon of higher octane value and to provide for a first reforming reactor effluent containing polynuclear aromatic compounds;

(c) contacting said first reforming reactor effluent with a first adsorbent effective to selectively adsorb said polynuclear aromatic compounds and to permit nonpolynuclear aromatic hydrocarbons to pass over said first adsorbent without being adsorbed and to form a first adsorbent bed effluent stream having a reduced amount of polynuclear aromatic compounds;

(d) heating said first adsorbent bed effluent stream to a temperature of from about 800° F. to about 1000° F. to form a second reforming reactor hydrocarbon feed stream;

(e) passing said heated adsorbent bed hydrocarbon feed stream to a second of a series of endothermic catalytic reforming reactors operated at a temperature of from about 800° F. to about 1000° F. to reform said hydrocarbon feed stream to a hydrocarbon of higher octane value and to provide for a second reforming reactor effluent containing polynuclear aromatic compounds;

(f) contacting said second reforming reactor effluent with a second adsorbent effective to selectively adsorb said polynuclear aromatic compounds and to permit nonpolynuclear aromatic hydrocarbons to pass over said adsorbent without being adsorbed and to form a second adsorbent bed effluent stream having a reduced amount of polynuclear aromatic compounds;

(g) adsorbent bed effluent stream to a temperature of from about 800° F. to about 1000° F. to form a feed stream for the next consecutive reforming reactor;

(h) continuing said reforming reactors in a series of subsequent catalytic reforming reactors as recited in steps (b) and (e) above with said intermediate polynuclear aromatic compound adsorption as recited in steps (c) and (f) above and with said heating after adsorption as recited in steps (d) and (g) above in each of said series of subsequent catalytic reforming reactors until the last in the series of said reforming reactors; and (i) recovering a hydrocarbon reformate from the last of said series of reforming reactors having a reduced content of polynuclear aromatic compounds.

14. The process of claim 13 wherein said feed stream comprises a $C_6$ to $C_{10}$ naphtha having a boiling point of from 100° to 400° F. and wherein said reformate possesses a higher octane value than said feed stream, said reformate being blended with gasoline to increase the relative octane value of the gasoline.

15. The process of claim 13 wherein said first and said second adsorbent is selected from the group consisting of a molecular sieve, silica, alumina, activated charcoal, silica-alumina and clays.

16. The process of claim 15 wherein said first and second adsorbents are the same selected adsorbent.

17. The process of claim 13 wherein said first adsorption bed of step (c) is contained in a bottom portion of said catalytic reforming reactor of step (b) and where said heating of said first adsorbent bed effluent stream is performed by a heat means intermediate said first and said second catalytic reforming reactors.

18. The process of claim 13 wherein said series of catalytic reforming reactors comprises at least four catalytic reforming reactors with three adsorption zone intermediate or within said respective reforming reactor and three heat means to elevate the temperature of said feed to the respective next catalytic reforming reactor to at least 750° F.

19. The process of claim 17 wherein said heat means comprises an indirect heat exchange by indirect contact with a heated effluent stream from a hydrocarbon conversion reactor.

20. The process of claim 13 wherein said catalytic reforming reactors contain a catalyst comprising an aluminosilicate having a Group VIII and Group VIIB metal deposited thereon.

* * * * *